US006953922B2

(12) United States Patent
Lee

(10) Patent No.: US 6,953,922 B2
(45) Date of Patent: Oct. 11, 2005

(54) COOKING APPARATUS AND METHOD OF CONTROLLING THE SAME

(75) Inventor: Won-Woo Lee, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 57 days.

(21) Appl. No.: 10/373,828

(22) Filed: Feb. 27, 2003

(65) Prior Publication Data

US 2004/0104225 A1 Jun. 3, 2004

(30) Foreign Application Priority Data

Nov. 29, 2002 (KR) ..... 10-2002-0075154

(51) Int. Cl.[7] ..... H05B 1/02
(52) U.S. Cl. ..... 219/710; 219/494; 219/492
(58) Field of Search ..... 219/710, 719, 219/685, 702, 715, 720, 711–713, 494, 492, 497

(56) References Cited

U.S. PATENT DOCUMENTS 2,392,166 A * 1/1946 Lockwood ..... 219/494
2,427,146 A * 9/1947 Lee ..... 392/441
2,623,449 A * 12/1952 Losee ..... 219/439
2,734,826 A * 2/1956 Stentz et al. ..... 219/385
2,820,130 A * 1/1958 Dadson ..... 219/494
2,933,585 A * 4/1960 Holtkamp ..... 219/494
2,993,974 A * 7/1961 Strobel ..... 219/494
3,400,886 A * 9/1968 Holtkamp ..... 219/413
4,309,584 A * 1/1982 Terakami ..... 219/720
4,379,964 A * 4/1983 Kanazawa et al. ..... 219/492
4,794,219 A * 12/1988 Eke ..... 219/719
4,908,760 A * 3/1990 Sinn ..... 219/494
4,927,998 A * 5/1990 Tamura et al. ..... 219/494
5,367,145 A * 11/1994 Takagi ..... 219/494
5,607,611 A * 3/1997 Lee ..... 219/702
6,013,907 A * 1/2000 Lee ..... 219/711
6,222,163 B1 * 4/2001 Arntz et al. ..... 219/494
6,818,865 B2 * 11/2004 Mangina ..... 219/494
2001/0030187 A1 * 10/2001 Shon et al. ..... 219/702
2002/0162833 A1 * 11/2002 Amtz et al. ..... 219/494

FOREIGN PATENT DOCUMENTS

KR 2000-9620 2/2000
KR 2002-45200 6/2002

* cited by examiner

*Primary Examiner*—Teresa J. Walberg
(74) *Attorney, Agent, or Firm*—Staas & Halsey LLP

(57) ABSTRACT

A cooking apparatus having heaters which performs cooking by taking a remaining heat of the heaters in a cooking cavity into consideration if food is cooked using a heating method through the heaters. The cooking apparatus performs cooking based on an accumulative temperature value of the cooking cavity in place of a cooking time, thereby optimally cooking foods even though cooking operations are continuously carried out. The cooking apparatus finishes the cooking if the accumulative temperature value of the cooking cavity reaches a temperature value set to correspond to a cooking level for toast, which is selected by a user.

46 Claims, 5 Drawing Sheets

COOKING APPARATUS AND METHOD OF CONTROLLING THE SAME

CROSS-REFERENCE TO RELATED APPLICATION(S)

This application claims the benefit of Korean Patent Application No. 2002-75154, filed Nov. 29, 2002, in the Korean Intellectual Property Office, the disclosure of which is incorporated herein by reference.

BACKGROUND OF THE INVENTION

1. Field of the Invention

The present invention relates, in general, to a cooking apparatus having heaters and, more particularly, to a cooking apparatus and a method of controlling the same, which prevents foods from burning due to a remaining heat of the heaters when the foods are continuously cooked.

2. Description of the Related Art

Generally, a cooking apparatus is a machine to cook food by transferring heat to the food. The cooking apparatus includes a microwave oven which cooks food using microwaves provided to an inside of a cooking cavity by a magnetron.

Further, a heater can be mounted in a cooking cavity as a heating source, as well as a magnetron in a microwave oven, such that cooking using the microwaves generated by the magnetron and cooking using the heater are independently performed or simultaneously performed.

For example, in a case of a food such as toast cooked by a heating operation by the heater, a plurality of buttons are provided on a control panel of the microwave oven so as to allow a user to select a cooking level of a particular food. If such a button is pressed, a control unit, which performs an entire control operation of the microwave oven, heats the particular food by operating the heater for a cooking period preset to correspond to the pressed button.

However, a conventional cooking apparatus, such as a microwave oven, is problematic, since a cooking period is fixed according to a cooking level of the food regardless of a temperature of a cooking cavity, heat generated from a previous cooking operation remains in the cooking cavity to burn foods if the cooking apparatus continuously cooks the foods using a heating operation by a heater.

Further, the conventional cooking apparatus is problematic in that, even though the foods are cooked for a same cooking period, the foods may not be uniformly cooked if the temperature of the cooking cavity is varied due to external factors.

SUMMARY OF THE INVENTION

Accordingly, it is an aspect of the present invention to provide a cooking apparatus and a method of controlling the same, which performs cooking based on a current temperature value of a cooking cavity.

Another aspect is to provide a cooking apparatus and a method of controlling the same, which performs cooking based on an accumulative temperature value of the cooking cavity.

A further aspect is to provide a cooking apparatus and a method of controlling the same, which performs cooking based on the accumulative temperature value of the cooking cavity when continuous cooking operations are performed.

Another aspect is to provide a cooking apparatus and a method of controlling the same, which sets a cooking period based on the current temperature value of the cooking cavity.

Additional aspects and/or advantages of the invention will be set forth in part in the description which follows and, in part, will be obvious from the description, or may be learned by practice of the invention.

The above and/or other aspects of the present invention are achieved by providing a cooking apparatus including at least one heater to heat food accommodated in a cooking cavity, a switching unit to switch an electrical connection between a power source and the at least one heater, a temperature detecting unit to detect a current temperature value of the cooking cavity, and a control unit to control the switching unit based on the detected current temperature value.

The above and/or other aspects of the present invention are achieved by providing a cooking apparatus including an input key, at least one heater, a switching unit, a temperature detecting unit, and a control unit. The input key inputs a cooking level of food accommodated in a cooking cavity, and the at least one heater heats the food. The switching unit switches an electrical connection between a power source and the at least one heater, and the temperature detecting unit detects current temperature values of the cooking cavity. The control unit repeatedly reads the current temperature values of the cooking cavity at regular intervals, accumulates the repeatedly read current temperature values to obtain an accumulative temperature value, and controls the switching unit by comparing the accumulative temperature value with a temperature value preset to correspond to an input signal from the input key.

The above and/or other aspects of the present invention are achieved by providing a cooking apparatus including an input key to input a cooking level of food accommodated in a cooking cavity, at least one heater to heat the food, a switching unit to switch an electrical connection between a power source and the at least one heater, a temperature detecting unit to detect a current temperature value of the cooking cavity, and a control unit to control the switching unit to turn off the at least one heater if a preset cooking period corresponding to the current temperature value of the cooking cavity, detected by the temperature detecting unit, has elapsed.

The above and/or other aspects of the present invention are achieved by providing a method of controlling a cooking apparatus, including operating at least one heater which heats food accommodated in a cooking cavity according to a cooking instruction and a cooking level instruction for the food, reading current temperature values of the cooking cavity at regular intervals, accumulating the read current temperature values to obtain an accumulative temperature value, and turning off the at least one heater if the accumulative temperature value has reached a temperature value set based on of the cooking level instruction.

The above and/or other aspects of the present invention are achieved by providing a method of controlling a cooking apparatus, including operating at least one heater which heats food accommodated in a cooking cavity according to a cooking instruction and a cooking level instruction for the food, reading a current temperature value of the cooking cavity, and turning off the at least one heater if a cooking period, set to correspond to the read current temperature value based on the cooking level instruction, has elapsed.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
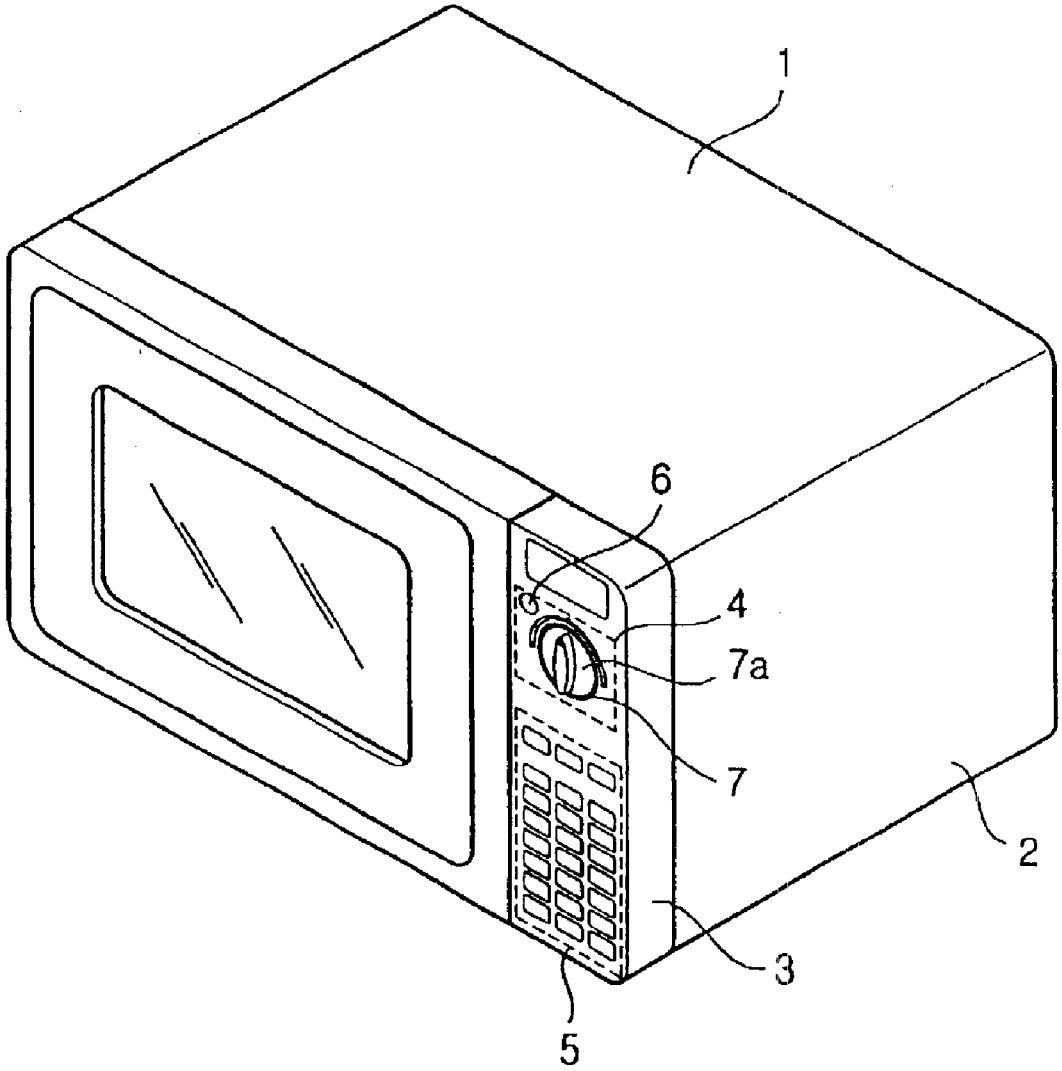
FIG. 1 is a perspective view illustrating a control panel of a microwave oven, according to a first embodiment of the present invention.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures.

The present invention relates to a cooking apparatus having heaters and a method of controlling the same. In the first, second and third embodiments, it is assumed that the cooking apparatus is a microwave oven.

FIG. 1 is a perspective view illustrating a control panel of a microwave oven according to a first embodiment of the present invention.

As shown in FIG. 1, a machine room 2 is formed in an oven body 1. A control panel 3 is mounted on a front of the machine room 2 so as to allow a user to manipulate the microwave oven. A cooking button group 4 to control a heater 11 or 12 is mounted (see FIG. 2) on the control panel 3. Further, a cooking button group 5 to control a magnetron MGT is mounted on the control panel 3. Further, in the cooking button group 4 to control a heater 11 or 12, there are provided a toast cooking button 6 to perform a toast cooking operation and an input key 7 to allow the user to select a cooking level of bread according to a taste of the user. The input key 7 has a jog dial 7*a* which is designed to output different electrical signals according to a rotated position thereof. For example, as the jog dial 7*a* is rotated clockwise, the bread is toasted for a longer period. Further, the cooking button group 5 to control the magnetron MGT is constructed in a same way as that of a conventional microwave oven.

Figure 2:
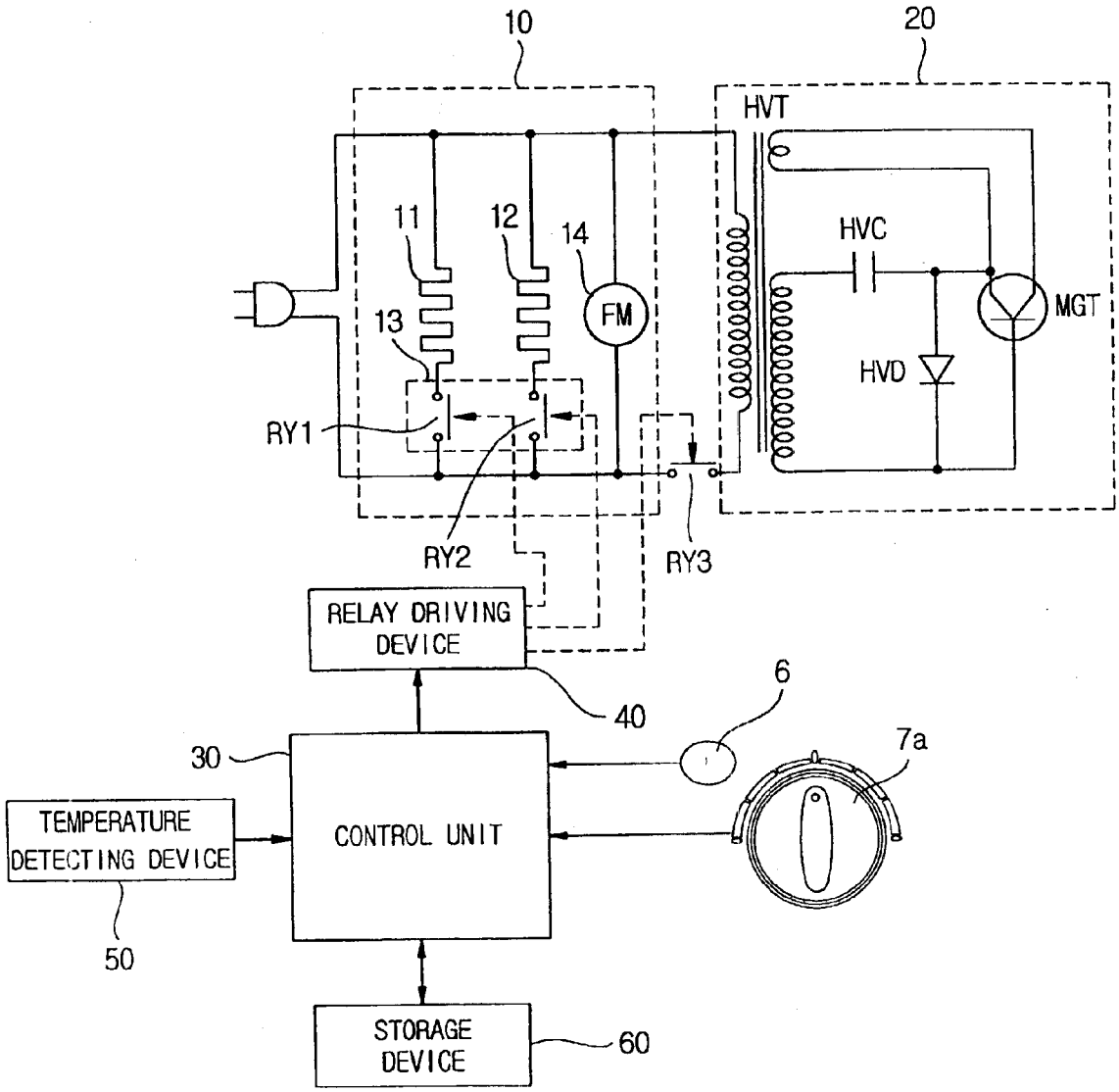
FIG. 2 is a control block diagram illustrating a cooking operation performed by a heater in the microwave oven of FIG. 1.

FIG. 2 is a control block diagram illustrating a cooking operation performed by the heater in the microwave oven of FIG. 1.

As shown in FIG. 2, the microwave oven includes a heater driving circuit 10 to drive an upper heater 11 and a lower heater 12. In the heater driving circuit 10, the upper heater 11 and the lower heater 12 are connected in parallel with each other between first and second ends of an input alternating current (AC) power source. The upper and lower heaters 11 and 12 are mounted in upper and lower portions of the cooking cavity, respectively. Further, a switching device 13 is arranged between the upper and lower heaters 11 and 12 and one terminal of the input AC power source. The switching device 13 turns-on or shuts-off power to the upper and lower heaters 11 and 12 by opening or closing electrical paths between the upper heater 11 and the input AC power source and between the lower heater 12 and the input AC power source. For example, the switching device 13 includes a first relay switch RY1 and a second relay switch RY2, which are turned-on or shut-off according to whether power is supplied to a relay coil, as shown in FIG. 2. The first relay switch RY1 is turned off to close an electrical path between the upper heater 11 and the input AC power source in a normal condition, and is turned on in response to an electrical signal to open the electrical path therebetween. Further, the second relay switch RY2 is turned off to close an electrical path between the lower heater 12 and the input AC power source in the normal condition, and is turned on in response to an electrical signal to open the electrical path therebetween. Reference numeral 14, which is not described, represents a fan motor 14.

Further, the microwave oven, according to this embodiment of the present invention, includes a high voltage unit control circuit 20 to drive a magnetron MGT. The high voltage unit control circuit 20 includes the magnetron MGT to oscillate and produce microwaves, a high voltage transformer HVT to boost a voltage obtained by the input AC power and supply the boosted voltage to the magnetron MGT, and a high voltage condenser HVC and a high voltage diode HVD which transform the voltage boosted through the high voltage transformer HVT into a high voltage having a direct current (DC). In this case, a third relay switch RY3 is arranged between one end of a primary coil of the high voltage transformer HVT and one terminal of the input AC power source so as to operate the magnetron MGT. Further, the high voltage unit control circuit 20 and the heater driving circuit 10 are connected in series with each other when the high voltage transformer HVT is powered through the third relay switch RY3.

Further, the microwave oven includes a control unit 30 to perform an entire control operation of the microwave oven. Further, the microwave oven includes a relay driving device 40 to turn-on or shut-off the first to third relay switches RY1 to RY3. In this case, the control unit 30 drives the relay driving device 40 by generating corresponding control signals in response to input signals from the toast cooking button 6 and the input key 7 which are mounted on the control panel 3.

Further, the microwave oven includes a temperature detecting device 50 to detect one or more current temperature values of the cooking cavity. Further, the microwave oven includes a storage device 60 in which the one or more temperature values of the cooking cavity, preset to correspond to the input signals of the input key 7 according to the rotating position of the jog dial 7*a*, are stored.

Figure 3:
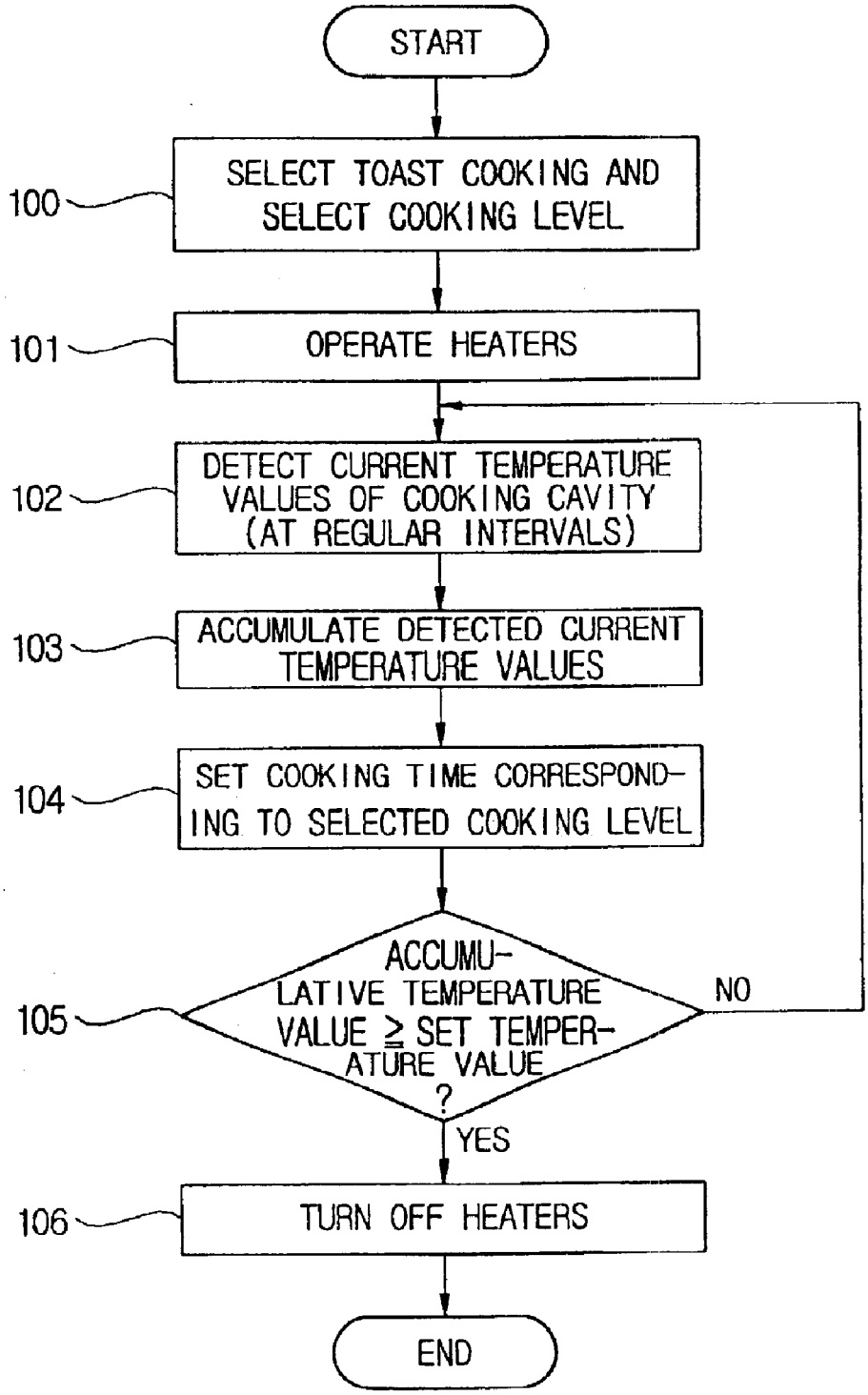
FIG. 3 is a control flowchart of a method of cooking toast based on an accumulative temperature value of the cooking cavity in the microwave oven, according to the first embodiment of the present invention.

FIG. 3 is a control flowchart of a method of cooking toast based on an accumulative temperature value of the cooking cavity in the microwave oven, according to the first embodiment of the present invention.

Referring to FIG. 3, after the user puts the bread in the cooking cavity and presses the toast cooking button 6 so as to toast the bread, the user adjusts the input key 7 to select a cooking level of the bread so as to toast the bread to a desired level at operation 100.

The control unit 30 allows the upper and lower heaters 11 and 12 to be supplied with the input AC power by operating the first and second relay switches RY1 and RY2 through the relay driving device 40 in response to input signals from the toast cooking button 6 and the input key 7, thus operating the upper and lower heaters 11 and 12 at operation 101. Accordingly, the bread in the cooking cavity is toasted.

Further, the control unit 30 detects the one or more current temperature values of the cooking cavity at regular intervals through the temperature detecting device 50 at operation 102. In this case, after the control unit 30 initially operates the upper and lower heaters 11 and 12 and then a predetermined period of time has elapsed, the control unit 30 detects the one or more current temperature values of the cooking cavity. The control unit 30 accumulates the detected one or more current temperature values at operation 103.

Thereafter, the control unit 30 sets a cooking time corresponding to the adjusted input key 7 by scanning the storage device 60, in which cooking time corresponding to cooking levels for toast are stored, to finish the cooking at operation 104.

After setting the temperature value, the control unit 30 determines whether an accumulative temperature value obtained at operation 103 is equal to or greater than the temperature value set at operation 104 by comparing the accumulative temperature value with the set temperature value at operation 105.

If the accumulative temperature value is equal to or greater than the set temperature value at operation 105, the control unit 30 shuts off the power supplied to the upper and lower heaters 11 and 12 by operating the first and second relay switches RY1 and RY2 through the relay driving device 40 so as to finish the cooking of the toast, thus turning off the upper and lower heaters 11 and 12 at operation 106. Accordingly, even though foods are continuously cooked, the microwave oven performs a next cooking operation with a remaining heat of the cooking cavity generated by the upper and lower heaters 11 and 12 and left over from a previous cooking operation, which is taken into consideration, thus optimally toasting the bread without burning the bread.

Figure 4:
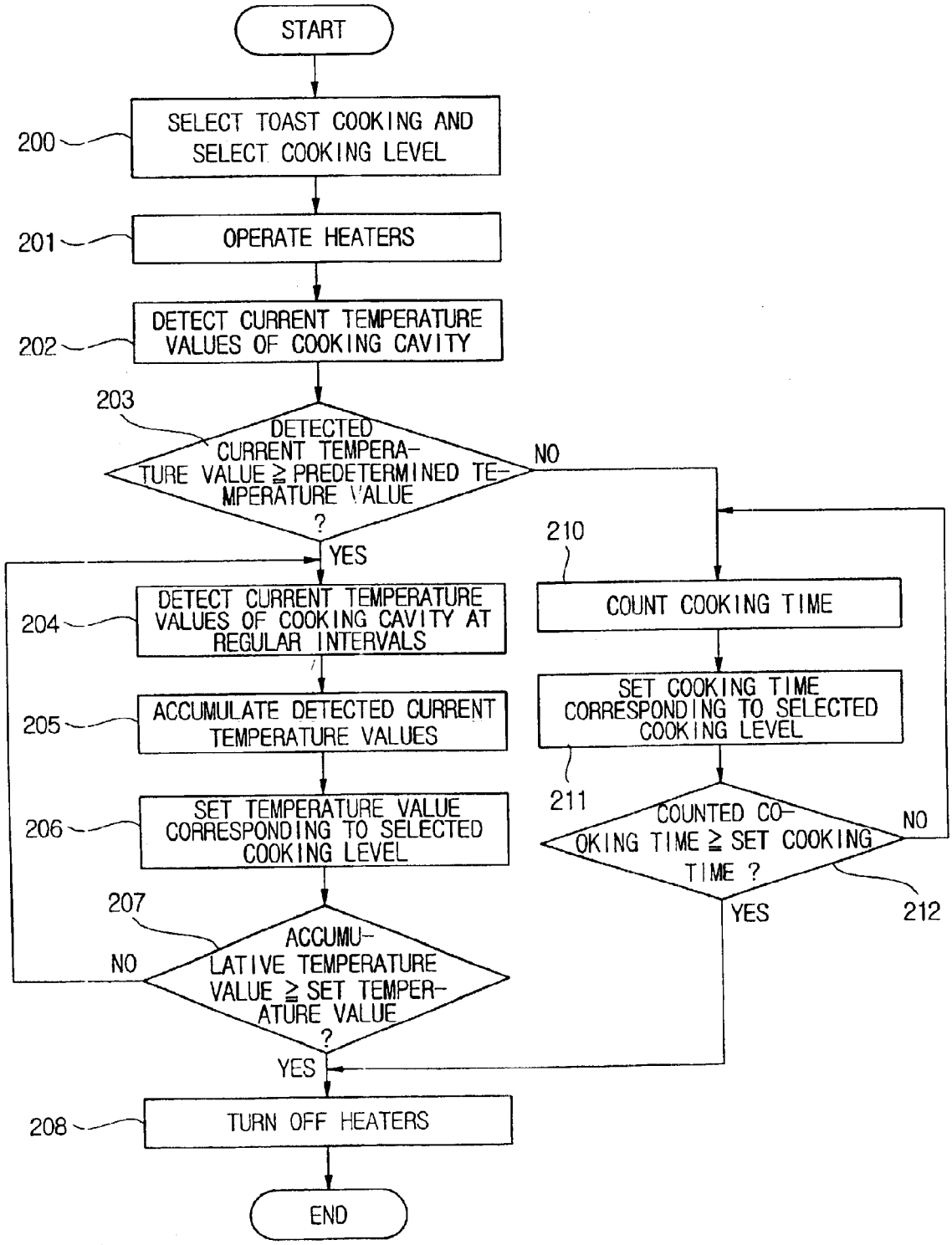
FIG. 4 is a control flowchart of a method of finishing cooking according to the accumulative temperature value of the cooking cavity if continuous cooking operations are performed, and finishing cooking according to a cooking period if continuous cooking operations are not performed, according to a second embodiment of the present invention.

FIG. 4 is a control flowchart of a method of finishing cooking according to an accumulative temperature value of the cooking cavity if continuous cooking operations are performed, and finishing cooking according to a cooking time if continuous cooking operations are not performed, according to a second embodiment of the present invention.

Referring to FIG. 4, after the user puts the bread in the cooking cavity and presses the toast cooking button 6 so as to toast the bread, the user adjusts the input key 7 to select the cooking level of the bread so as to toast the bread to the desired level at operation 200.

The control unit 30 allows the upper and lower heaters 11 and 12 to be supplied with the input AC power by operating the first and second relay switches RY1 and RY2 through the relay driving device 40 in response to input signals from the toast cooking button 6 and the input key 7, thus operating the upper and lower heaters 11 and 12 at operation 201. Accordingly, the bread in the cooking cavity is toasted.

The control unit 30 detects the one or more current temperature values of the cooking cavity through the temperature detecting device 50 at operation 202. In this case, after the control unit 30 operates the upper and lower heaters 11 and 12 and then a predetermined period of time has elapsed, the control unit 30 detects the one or more current temperature values of the cooking cavity. Thereafter, the control unit 30 determines whether the one or more detected current temperature values are equal to or greater than respective predetermined temperature values by comparing the one or more detected current temperature values with the respective predetermined temperature values so as to check whether foods are continuously cooked at operation 203. That is, if foods are continuously cooked, the temperature in the cooking cavity is already high due to the remaining heat of the heaters left over from the previous cooking operation. Accordingly, the control unit 30 may check whether continuous cooking operations are performed by detecting the one or more current temperature values of the cooking cavity and comparing the one or more detected current temperature values with the respective predetermined temperature values.

If continuous cooking operations are performed, and so the one or more current temperature values are equal to or greater than the respective predetermined temperature values, the control unit 30 detects current temperature values of the cooking cavity at regular intervals through the temperature detecting device 50 at operation 204. Thereafter, the control unit 30 accumulates the corresponding detected current temperature values detected at regular intervals at operation 205.

The control unit 30 sets a temperature value corresponding to the adjusted input key 7 by scanning the storage device 60, in which temperature values corresponding to cooking levels of toast are stored, to finish the cooking at operation 206.

After setting the temperature value, the control unit 30 determines whether the accumulative temperature value obtained at operation 205 is equal to or greater than the temperature value set at operation 206 by comparing the accumulative temperature value with the set temperature value at operation 207.

If the accumulative temperature value is determined to be equal to or greater than the set temperature value at operation 207, the control unit 30 turns off the upper and lower heaters 11 and 12 so as to finish the cooking of the toast at operation 208.

Further, if continuous cooking operations are not performed, and so the one or more detected temperature values are less than the respective predetermined temperature value at operation 203, the control unit 30 counts a cooking time at operation 210.

Further, the control unit 30 sets a cooking time corresponding to the adjusted input key 7 by scanning the storage device 60, in which cooking times corresponding to cooking levels for toast are stored, to finish the cooking at operation 211.

After setting the cooking time, the control unit 30 determines whether the counted cooking time is equal to or longer than the set cooking time by comparing the counted cooking time with the set cooking time at operation 212.

If the counted cooking time is determined to be equal to or longer than the set cooking time at operation 212, the control unit 30 turns off the heaters 11 and 12 so as to finish the cooking of the toast at operation 208.

Figure 5:
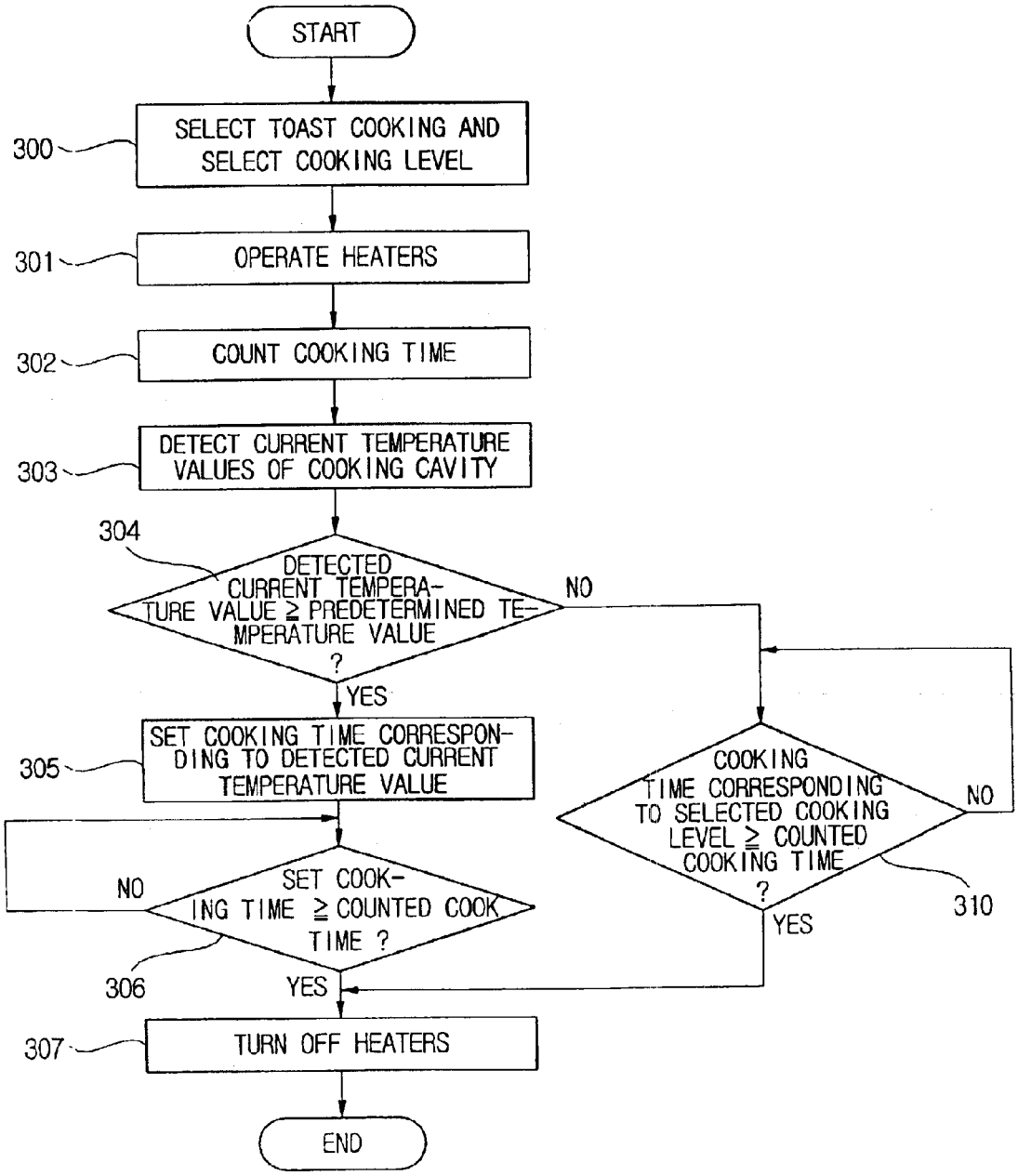
FIG. 5 is a control flowchart of a method of setting a cooking period based on a current temperature value of the cooking cavity in the microwave oven, according to a third embodiment of the present invention.

FIG. 5 is a control flowchart of a operation of setting a cooking time based on the current temperature of the cooking cavity in the microwave oven, according to a third embodiment of the present invention.

Referring to FIG. 5, after the user puts bread in the cooking cavity and presses the toast cooking button 6 so as to toast the bread, the user adjusts the input key 7 to select a cooking level of bread so as to toast the bread to a desired level at operation 300.

The control unit 30 allows the upper and lower heaters 11 and 12 to be supplied with the input AC power by operating the first and second relay switches RY1 and RY2 through the relay driving device 40 in response to the input signals from the toast cooking button 6 and the input key 7, thus operating the upper and lower heaters 11 and 12 at operation 301. Accordingly, the bread in the cooking cavity is toasted. At this time, the control unit 30 counts a cooking time at operation 302.

Further, the control unit detects one or more current temperature values of the cooking cavity through the temperature detecting device 50 at operation 303. In this case, after the control unit 30 operates the upper and lower heaters 11 and 12, and then a predetermined period of time has elapsed, the control unit 30 detects the one or more current temperature values of the cooking cavity. Thereafter, the control unit 30 determines whether the one or more detected current temperature values are equal to or greater than respective predetermined temperature values by comparing the one or more detected current temperature values with the respective predetermined temperature values so as to check whether foods are continuously cooked at operation 304. That is, if the foods are continuously cooked, the temperature in the cooking cavity is already high due to the remaining heat of the heaters left over from the previous cooking. Accordingly, the control unit 30 may check whether the continuous cooking operations are performed by detecting the one or more current temperature values of the cooking cavity and comparing the detected current temperature values with the respective predetermined temperature values.

If continuous cooking operations are performed, and so the one or more current temperature values are equal to or greater than the respective predetermined temperature values, the control unit 30 finds a cooking time corresponding to the adjusted input key 7 by scanning the storage device 60, in which cooking times corresponding to cooking levels for the toast to be continuously cooked are stored, and sets the found cooking time as a cooking time for the toast cooking at operation 305.

After setting the cooking time, the control unit 30 determines whether the set cooking time is equal to or longer than the counted cooking time by comparing the set cooking time with the counted cooking time at operation 306.

If the set cooking time is determined to be equal to or longer than the counted cooking time at operation 306, the control unit 30 turns off the upper and lower heaters 11 and 12 so as to finish the cooking of the toast at operation 307.

Further, if the continuous cooking operations are not performed and so the one or more detected current temperature values are less than the respective predetermined temperature values at operation 304, the control unit 30 finds a cooking time corresponding to the adjusted input key 7 by scanning the storage device 60, in which the cooking times corresponding to the cooking levels for the toast are stored, to finish the cooking, and determines whether the found cooking time is equal to or longer than the counted cooking time by comparing the found cooking time with the counted cooking time at operation 310.

If the found cooking time is determined to be equal to or longer than the counted cooking time at operation 310, the control unit 30 turns off the upper and lower heaters 11 and 12 so as to finish the cooking of the toast at operation 307.

As is apparent from the above description, a cooking apparatus and a method of controlling the same is provided, which performs cooking based on, for example, a current temperature value of a cooking cavity, such that the current temperature value of the cooking cavity is reflected in the cooking course, thus optimally cooking the foods.

Further, the present invention performs cooking based on, for example, an accumulative temperature value of the cooking cavity in place of the cooking time, thereby preventing the foods from being excessively cooked even though the temperature of the cooking cavity is varied due to external factors at the time of cooking.

Further, the present invention sets a cooking time based on the current temperature value of the cooking cavity, thus preventing the foods from burning.

Moreover, the present invention performs cooking by taking the one or more current temperature values of the cooking cavity into consideration, thus preventing the foods from being excessively cooked even though the continuous cooking operations are performed.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cooking apparatus with a cooking cavity comprising:

at least one heater to heat food accommodated in the cooking cavity;

a switching unit to switch an electrical connection between a power source and the at least one heater;

a temperature detecting unit to detect a current temperature values of the cooking cavity; and a control unit to control the switching unit based on the detected current temperature values, wherein said control unit controls the switching unit to turn off the at least one heater if an accumulative temperature value, obtained by accumulating the current temperature values of the cooking cavity detected at regular intervals through the temperature detecting unit, reaches a preset temperature value.

2. The cooking apparatus according to claim 1, wherein said control unit detects the current temperature values of the cooking cavity through the temperature detecting unit, and controls the switching unit to turn off the heater if a preset cooking time corresponding to a respective one of the detected temperature values elapses.

3. A cooking apparatus with a cooking cavity comprising:

an input key to input a cooking level of food accommodated in the cooking cavity;

at least one heater to heat the food;

a switching unit to switch an electrical connection between a power source and the at least one heater, a temperature detecting unit to detect current temperature values of the cooking cavity; and a control unit to read the current temperature values of the cooking cavity at regular intervals, to accumulate the current temperature values to obtain an accumulative temperature value, and to control the switching unit by comparing the accumulative temperature value with a temperature value preset to correspond to an input signal from the input key.

4. The cooking apparatus according to claim 3, wherein said control unit controls the switching unit to turn off the at least one heater if the accumulative temperature value of the cooking cavity is equal to or greater than the preset temperature value.

5. The cooking apparatus according to claim 3, wherein said control unit reads the current temperature values of the cooking cavity from the temperature detecting unit after the at least one heater is initially operated and a predetermined period of time elapses.

6. The cooking apparatus according to claim 3, wherein said input key is a jog dial.

7. The cooking apparatus according to claim 3, further comprising:

a toast cooking button to perform toast cooking.

8. The cooking apparatus according to claim 3, wherein said cooking apparatus is a microwave oven.

9. A cooking apparatus with a cooking cavity comprising:

an input key to input a cooking level of food accommodated in the cooking cavity;

at least one heater to heat the food;

a switching unit to switch an electrical connection between a power source and the at least one heater;

a temperature detecting unit to detect current temperature values of the cooking cavity to determine an accumulative temperature value; and a control unit to control the switching unit to turn off the at least one heater according to the accumulative temperature value.

10. The cooking apparatus according to claim 9, wherein said input key is a jog dial.

11. The cooking apparatus according to claim 9, further comprising:

a toast cooking button to perform toast cooking.

12. A method of controlling a cooking apparatus having a cooking cavity, comprising:

operating at least one heater which heats food accommodated in the cooking cavity according to a cooking instruction and a cooking level instruction for the food;

reading current temperature values of the cooking cavity at regular intervals;

accumulating the read current temperature values to obtain an accumulative temperature value; and turning off the heater if the accumulative temperature value reaches a temperature value set based on the cooking level instruction.

13. The method of controlling a cooking apparatus according to claim 12, wherein the reading of the current temperature values of the cooking cavity is performed after the at least one heater is initially operated and a predetermined period of time elapses.

14. The method of controlling a cooking apparatus according to claim 12, wherein the turning off of the one or more heater comprises:

comparing a read current temperature value of the cooking cavity with a predetermined temperature value;

turning off the at least one heater after the accumulative temperature value reaches the set temperature value, if the read current temperature value of the cooking cavity is equal to or greater than the predetermined temperature value; and turning off the heater after a cooking time preset to correspond to the cooking level instruction elapses, if the read current temperature value of the cooking cavity is less than the predetermined temperature value.

15. A method of controlling a cooking apparatus having a cooking cavity, comprising:

operating at least one heater which heats food accommodated in the cooking cavity according to a cooking instruction and a cooking level instruction for the food;

reading a current temperature values of the cooking cavity to determine an accumulative temperature value; and turning off the at least one heater if the accumulative temperature value reaches a first predetermined temperature value.

16. The method of controlling a cooking apparatus according to claim 15, wherein the turning off of the at least one heater further comprises:

comparing a respective one of the read current temperature values of the cooking cavity with a second predetermined temperature value;

turning off the at least one heater after a first cooking time preset to correspond to the respective read current temperature value elapses, if the respective read current temperature value of the cooking cavity is equal to or greater than the second predetermined temperature value; and turning off the heater after a second cooking time preset to correspond to an input signal from an input key elapses, if the respective read current temperature value of the cooking cavity is less than the second predetermined temperature value.

17. The method of controlling a cooking apparatus according to claim 16, wherein said first cooking time is shorter than said second cooking time.

18. A cooking apparatus with a cooking cavity comprising:

one or more heaters to heat food accommodated in the cooking cavity;

a temperature detecting unit to detect over a period of time temperature values of the cooking cavity to determine an accumulative temperature value obtained by accumulating the detected temperature values; and a switching unit to turn on and off selected one or ones of the heaters based on the accumulative temperature value.

19. A cooking apparatus with a cooking cavity comprising:

a plurality of heaters to heat food accommodated in the cooking cavity;

a temperature detecting unit to detect repeatedly current temperature values of the cooking cavity to determine an accumulative temperature value obtained by accumulating the detected temperature values; and a switching unit to turn on and off selected one or ones of the heaters based on the accumulative temperature value.

20. The cooking apparatus according to claim 19, further comprising:

a control unit to control the switching unit to turn off the selected one or ones of the heaters if the accumulative temperature value reaches a preset temperature value.

21. The cooking apparatus according to claim 19, further comprising:

a control unit to receive the one or more detected current temperature values of the cooking cavity from the temperature detecting unit, and to control the switching unit to turn off the selected one or ones of the heaters if a preset cooking time elapses corresponding to a respective one of the detected current temperature values.

22. The cooking apparatus according to claim 19, further comprising:

a storage unit in which the one or more current temperature values of the cooking cavity detected repeatedly are stored.

23. The cooking apparatus according to claim 22, further comprising:

an input key to input a cooking level of food accommodated in the cooking cavity; and a control unit to set the one or more current temperature values corresponding to the input key and scanned by the storage unit, in which the one or more current temperature values corresponding to preset cooking levels are stored.

24. A cooking apparatus with a cooking cavity comprising:

an input key to input a cooking level of food accommodated in the cooking cavity;

a plurality of heaters to heat the food;

a temperature detecting unit to detect repeatedly one or more current temperature values of the cooking cavity;

a switching unit to turn on and off selected one or ones of the heaters based on the one or more repeatedly detected current temperature values; and a control unit receiving corresponding one or ones of the repeatedly detected current temperature values of the cooking cavity and accumulating the corresponding one or ones of the repeatedly detected current temperature values received to obtain an accumulative temperature value, and controlling the switching unit by comparing the accumulative temperature value with a temperature value preset to correspond to an input signal from the input key.

25. The cooking apparatus according to claim 24, further comprising:

a jog dial to set the input key according to a rotated position of the jog dial, wherein the one or more current temperature values detected repeatedly are preset to correspond to the rotated position of the jog dial.

26. The cooking apparatus according to claim 24, wherein the control unit controls the switching unit to turn off the selected one or ones of the heaters if the accumulative temperature value of the cooking cavity is equal to or greater than the preset temperature value.

27. The cooking apparatus according to claim 24, wherein the control unit receives the one or more repeatedly detected current temperature values of the cooking cavity from the temperature detecting unit after the selected one or ones of the heaters are initially operated and a predetermined period of time elapses.

28. The cooking apparatus according to claim 4, wherein the input key comprises:

a jog dial.

29. The cooking apparatus according to claim 24, wherein the input key comprises:

a plurality of buttons to set the cooking level of the food accommodated in the cooking cavity.

30. The cooking apparatus according to claim 24, further comprising:

a toasting button to set a toasting mode.

31. The cooking apparatus according to claim 26, wherein the cooking apparatus comprises:

a microwave oven to cook by radiating microwaves.

32. A cooking apparatus with a cooking cavity comprising:

an input key to input a cooking level of food accommodated in the cooking cavity;

a plurality of heaters to heat the food;

a temperature detecting unit to detect repeatedly current temperature values of the cooking cavity;

a switching unit to switch an electrical connection between a power source and selected one or ones of the heaters; and a control unit to control the switching unit to turn off the selected one or ones of the heaters if a preset cooking time elapses based on the cooking level of the food inputted from the input key and an accumulative value of the current temperature values of the cooking cavity.

33. The cooking apparatus according to claim 32, wherein the input key comprises:

a jog dial.

34. The cooking apparatus according to claim 32, wherein the input key comprises:

a plurality of buttons to set the cooking level of the food accommodated in the cooking cavity.

35. The cooking apparatus according to claim 32, further comprising:

a toasting button to set a toasting mode.

36. A method of controlling a cooking apparatus having a cooking cavity, comprising:

inputting a cooking level of food accommodated in the cooking cavity;

heating the food using a plurality of heaters;

detecting a temperature value of the cooking cavity at regular intervals;

accumulating the detected temperature values to determine an accumulative temperature value; and turning on and off selected one or ones of the heaters based on the accumulative value and the cooking level of the food inputted.

37. A method of controlling a cooking apparatus having a cooking cavity, comprising:

inputting a cooking level of food accommodated in the cooking cavity;

heating the food using a plurality of heaters;

repeatedly detecting current temperature values of the cooking cavity; accumulating the detected temperature values to determine an accumulative temperature value; and turning on and off selected one or ones of the heaters based on the accumulative temperature value level of the food inputted.

38. A method of controlling a cooking apparatus having a cooking cavity, comprising:

operating a plurality of heaters to heat food accommodated in the cooking cavity according to a cooking instruction and a cooking level instruction for the food;

detecting one or more current temperature values of the cooking cavity at regular intervals;

accumulating corresponding one or ones of the current temperature values detected at the regular intervals to obtain an accumulative temperature value; and turning off the heater if the accumulative temperature value reaches a temperature value set based on the cooking level instruction.

39. The method of controlling a cooking apparatus according to claim 38, wherein the detecting of the one or more current temperature values of the cooking cavity is performed after the plurality of heaters initially operates and a predetermined period of time elapses.

40. The method of controlling a cooking apparatus according to claim 38, wherein the turning off of the plurality of heaters comprises:

comparing corresponding one or ones of the current temperature values of the cooking cavity with a set temperature value;

turning off selected one or ones of the plurality of the heaters after the accumulative temperature value reaches the set temperature value, if the corresponding one or ones of the current temperature values of the cooking cavity are equal to or greater than the predetermined temperature value; and turning off the heater after a cooking time preset to correspond to the cooking level instruction elapses, if the corresponding one or ones of the current temperature values of the cooking cavity is less than the set temperature value.

41. The method of controlling a cooking apparatus according to claim 40, further comprising:

storing the corresponding one or ones of the current temperature values used in the comparing.

42. A method of controlling a cooking apparatus having a cooking cavity, comprising:

operating a plurality of heaters to heat food accommodated in the cooking cavity according to a cooking instruction and a cooking level instruction for the food;

reading a plurality of current temperature values of the cooking cavity;

accumulating the detected temperature values to determine an accumulative temperature value; and turning off the selected one or ones of the heaters if a cooking time set to correspond to a respective one of the read current temperature values based the cooking level instruction elapses.

43. The method of controlling a cooking apparatus according to claim 42, wherein the turning off of the selected one or ones of the heaters comprises:

comparing the respective read current temperature value of the cooking cavity with a predetermined temperature value;

turning off the selected one or ones of the heaters after a first cooking time preset to correspond to the respective read current temperature value elapses, if the respective read current temperature value of the cooking cavity is equal to or greater than the predetermined temperature value; and turning off the selected one or ones of the heaters after a second cooking time preset to correspond to an input signal from an input key elapses, if the respective read current temperature value of the cooking cavity is less than the predetermined temperature value.

44. The method of controlling a cooking apparatus according to claim 43, wherein the first cooking time is shorter than the second cooking time.

45. A method of controlling a cooking apparatus having a cooking cavity, comprising:

operating in a continuous cooking mode, when one or more current temperature values of the cooking cavity detected by a temperature detector are equal to or greater than respective predetermined temperature values, such that a preset cooking time of food placed in the cooking cavity is adjusted based on the one or more detected current temperature values;

turning off the heaters in the continuous cooking mode when an accumulative temperature value of the detected current temperature values is greater than a set value; and operating in a non-continuous cooking mode, when the one or more current temperature values of the cooking cavity detected by the temperature detector are less than the respective predetermined temperature values, such that the food is cooked for the preset cooking time.

46. A method of controlling a cooking apparatus having a cooking cavity, comprising:

setting a cooking time of a food placed in the cooking cavity based on a cooking level; and adjusting the set cooking time of the food based on an accumulative value of detected current temperature values, when a remaining heat of a previous cooking operation is equal to or greater than a predetermined temperature value.

* * * * *

UNITED STATES PATENT AND TRADEMARK OFFICE

CERTIFICATE OF CORRECTION

PATENT NO. : 6,953,922 B2
APPLICATION NO. : 10/373828
DATED : October 11, 2005
INVENTOR(S) : Won-Woo Lee It is certified that error appears in the above-identified patent and that said Letters Patent is hereby corrected as shown below:

On the title page item (56), Page 1, Column 2, Item (56) List of References, line 13, replace "Amtz et al." with --Arntz et al.--, therefor;

Column 8, line 31, Claim 1, after "detect" delete "a";

Column 8, line 53, Claim 3, replace "heater," with --heater;--. therefor;

Column 10, line 1, Claim 15, after "reading", delete "a";

Column 11, line 47, Claim 28, replace "claim 4" with --claim 24--, therefor;

Column 12, line 29, Claim 36 after "accumulative" insert --temperature--;

Column 12, line 42, Claim 37, after "value", insert --and the cooking--;

Column 13, line 27,Claim 42, after "based", insert --on--.

Signed and Sealed this

Fifteenth Day of August, 2006

JON W. DUDAS
*Director of the United States Patent and Trademark Office*